US011335288B2

(12) United States Patent
Chen

(10) Patent No.: US 11,335,288 B2
(45) Date of Patent: May 17, 2022

(54) CONTROL CHIP FOR USE IN VARIABLE REFRESH RATE AND RELATED DISPLAY DEVICE AND DRIVING METHOD

(71) Applicant: Realtek Semiconductor Corporation, Hsinchu (TW)

(72) Inventor: Li-Ang Chen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 16 days.

(21) Appl. No.: 17/136,210

(22) Filed: Dec. 29, 2020

(65) Prior Publication Data

US 2021/0210037 A1 Jul. 8, 2021

(30) Foreign Application Priority Data

Jan. 2, 2020 (TW) ..... 109100102

(51) Int. Cl.
*G09G 3/36* (2006.01)
*G09G 3/34* (2006.01)

(52) U.S. Cl.
CPC ..... *G09G 3/3618* (2013.01); *G09G 3/3406* (2013.01); *G09G 2320/0626* (2013.01)

(58) Field of Classification Search
CPC ..... G09G 3/3618; G09G 3/3406; G09G 2320/0626; G09G 5/005; G09G 3/3648; G09G 5/12; G09G 3/3611; G09G 3/342
See application file for complete search history.

(56) References Cited

U.S. PATENT DOCUMENTS

2008/0036715 A1* 2/2008 Lee ..... G09G 3/3648 345/87
2010/0156866 A1* 6/2010 Yeo ..... G09G 3/3406 345/55
2012/0162289 A1* 6/2012 Oniki ..... G09G 3/342 345/102
2014/0198093 A1* 7/2014 Nambi ..... G09G 3/3611 345/212
2015/0109286 A1 4/2015 Verbeure et al.
2020/0090596 A1* 3/2020 Oh ..... G09G 3/3406
2020/0105177 A1* 4/2020 Choi ..... G09G 5/005
2020/0279533 A1* 9/2020 Fan ..... G09G 5/12

OTHER PUBLICATIONS

Display-Corner, "Combining variable refresh rate and strobed backlight", retrieved from https://display-corner.epfl.ch/index.php/Combining_variable_refresh_rate_and_strobed_backlight.

* cited by examiner

*Primary Examiner* — Richard J Hong
(74) *Attorney, Agent, or Firm* — Locke Lord LLP; Tim Tingkang Xia, Esq.

(57) ABSTRACT

A control chip configured to be coupled with a backlight driving chip and a display panel is provided. The control chip includes a storage element and a processing circuit. The storage element is configured to store a predetermined vertical refresh rate of the display panel. The processing circuit is coupled with the storage element, and is configured to provide a switching signal to the backlight driving chip so that the backlight driving chip enables a backlight module according to the switching signal. A frequency of the switching signal is equal to the predetermined vertical refresh rate. If the processing circuit has not received a vertical refresh starting pulse for more than a predetermined frame time corresponding to the predetermined vertical refresh rate, the processing circuit increases the frequency of the switching signal.

20 Claims, 4 Drawing Sheets

CONTROL CHIP FOR USE IN VARIABLE REFRESH RATE AND RELATED DISPLAY DEVICE AND DRIVING METHOD

CROSS-REFERENCE TO RELATED APPLICATION

This application claims priority to Taiwan Patent Application Serial Number 109100102, filed on Jan. 2, 2020, which is herein incorporated by reference in its entirety.

BACKGROUND

Field of Invention

The present disclosure generally relates to a display device. More particularly, the present disclosure relates to a control chip capable of providing a constant brightness under variable refresh rate and related driving method.

Description of Related Art

LCD monitors that support variable refresh rate (VRR) often use high-brightness but short-duration strobe backlight to solve the problem of motion blur, and further constantly turn on the backlight at low brightness level, when refresh period extends, to ensure that user feels constant equivalent brightness. However, the above method requires rapidly switching the duty cycle of analog dimming control signals of the backlight module. Based on capacitor charge and discharge characteristics of the circuit, those control signals are hardly to be immediately changed to target waveforms. Therefore, backlight modules on the market cannot provide a constant equivalent brightness under the variable refresh rate.

SUMMARY

The disclosure provides a control chip configured to be coupled with a backlight driving chip and a display panel. The control chip includes a storage element and a processing circuit. The storage element is configured to store a predetermined vertical refresh rate of the display panel. The processing circuit is coupled with the storage element, and is configured to provide a switching signal to the backlight driving chip so that the backlight driving chip enables a backlight module according to the switching signal. A frequency of the switching signal is set according to the predetermined vertical refresh rate. If the processing circuit has not received a vertical refresh starting pulse for more than a predetermined frame time corresponding to the predetermined vertical refresh rate, the processing circuit increases the frequency of the switching signal.

The disclosure provides a display device including a display panel, a backlight driving chip coupled with the backlight module, and a control chip coupled with the display panel and the backlight driving chip. The control chip includes a storage element and a processing circuit. The storage element is configured to store a predetermined vertical refresh rate of the display panel. The processing circuit is coupled with the storage element, and is configured to provide a switching signal to the backlight driving chip so that the backlight driving chip enables the backlight module according to the switching signal. A frequency of the switching signal is set according to the predetermined vertical refresh rate. If the processing circuit has not received a vertical refresh starting pulse for more than a predetermined frame time corresponding to the predetermined vertical refresh rate, the processing circuit increases the frequency of the switching signal.

The disclosure provides a driving method suitable for a control chip configured to be coupled with a display panel and a backlight driving chip. The driving method includes the following operations: providing a switching signal to the backlight driving chip so that the backlight driving chip enables a backlight module according to the switching signal, and a frequency of the switching signal is set according to a predetermined vertical refresh rate of the display panel; determining whether a vertical refresh starting pulse has not been received for more than a predetermined frame time corresponding to the predetermined vertical refresh rate; and if the vertical refresh starting pulse has not been received for more than the predetermined frame time, increasing the frequency of the switching signal.

It is to be understood that both the foregoing general description and the following detailed description are by examples, and are intended to provide further explanation of the disclosure as claimed.

DETAILED DESCRIPTION

Figure 1:
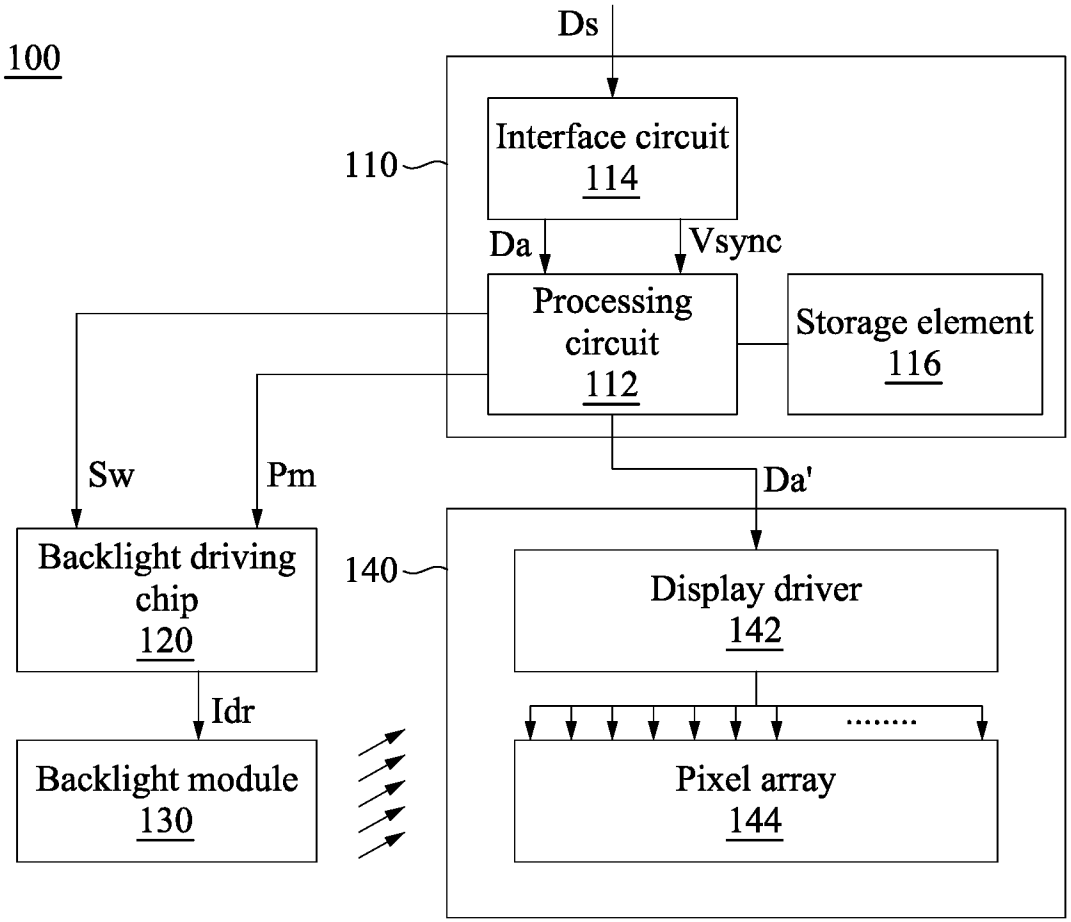
FIG. 1 is a simplified functional block diagram of a display device according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
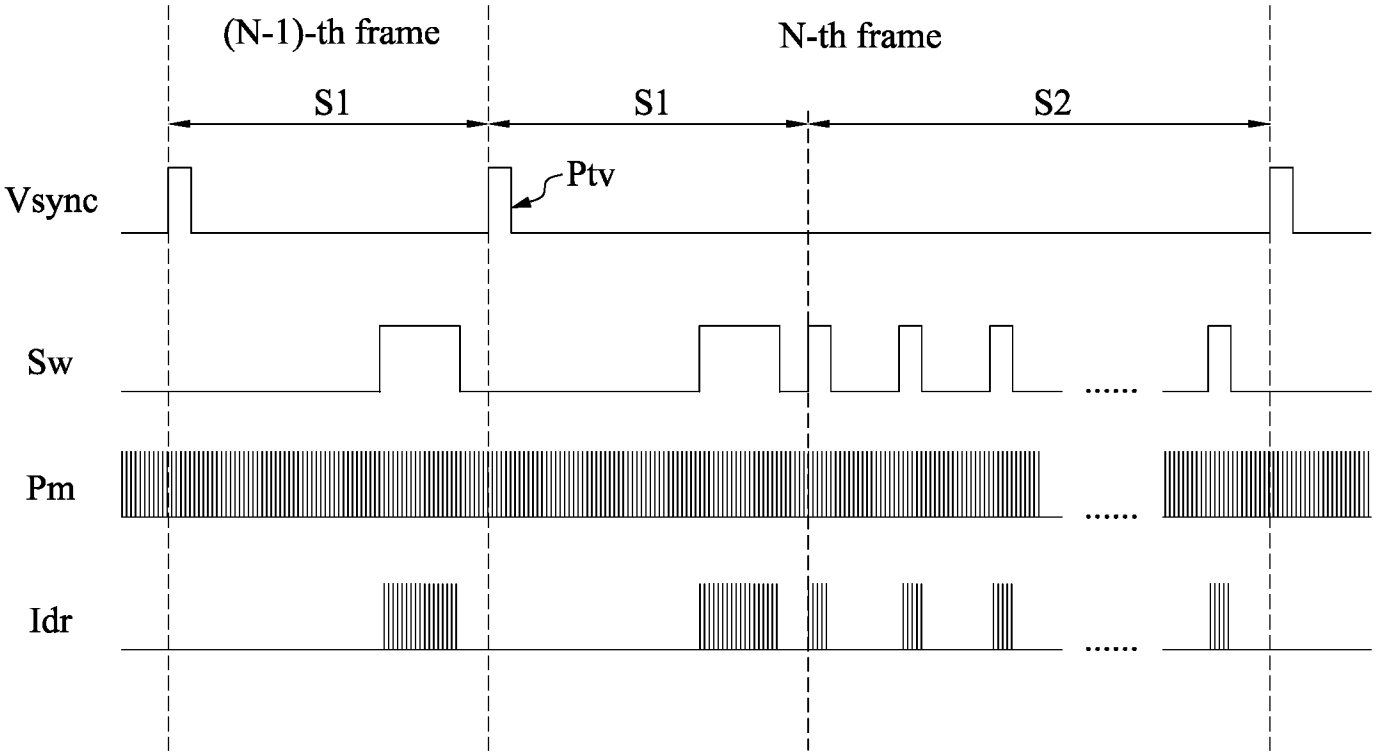
FIG. 2 is a waveform schematic diagram of a plurality of signals related to the display device of FIG. 1 according to one embodiment of the present disclosure.

FIG. 1 is a simplified functional block diagram of a display device 100 according to one embodiment of the present disclosure. FIG. 2 is a waveform schematic diagram of a plurality of signals related to the display device 100 according to one embodiment of the present disclosure. Referring to FIGS. 1-2, the display device 100 comprises a control chip 110, a backlight driving chip 120, a backlight module 130, and a display panel 140. In this embodiment, the display device 100 supports variable refresh rate. Variable refresh rate means that the vertical refresh rate of displayed images may be non-constant. For the sake of brevity, other functional blocks of the display device 100 are not shown in FIG. 1.

The control chip 110 is coupled with the backlight driving chip 120 and the display panel 140, and comprises a processing circuit 112, an interface circuit 114, and a storage element 116. The storage element 116 stores a predetermined vertical refresh rate (e.g., 120 Hz or 144 Hz) of the display panel 140. In some embodiments, the predetermined vertical refresh rate is the maximum vertical refresh rate that the display panel 140 supports. The interface circuit 114 is configured to receive a display signal Ds from an external device (e.g., an independent graphic card or a CPU, not shown in FIG. 1), and is configured to obtain a vertical sync signal Vsync and a data signal Da from the display signal Ds. The processing circuit 112 is coupled with the interface circuit 114 and the storage element 116, and is configured to provide a pulse width modulation (PWM) control signal Pm and a switching signal Sw to the backlight driving chip 120. The processing circuit 112 adjusts, according to the vertical sync signal Vsync and the predetermined vertical refresh rate of the display panel 140, waveforms of the PWM control signal Pm and the switching signal Sw. Methods for adjusting those waveforms will be described in detail in the following paragraphs.

The processing circuit 112 is further configured to optimize the data signal Da. For example, the processing circuit 112 may adjust the image resolution, the image aspect ratio, and other image parameters carried by the data signal Da. The display panel 140 comprises a display driver 142 and a pixel array 144, and the display driver 142 is configured to drive, according to the optimized data signal Da', the pixel array 144 to display images.

The backlight driving chip 120 is coupled with the backlight module 130, and is configured to provide a driving current Idr to enable the backlight module 130. The backlight driving chip 120 determines, according to the switching signal Sw, whether to provide the driving current Idr. The backlight driving chip 120 further determines, according to a duty cycle of the PWM control signal Pm, the value of the driving current Idr. In one embodiment, the duty cycle of the PWM control signal Pm is positively correlated to the value of the driving current Idr. The term duty cycle in this disclosure means that a ratio of the signal ON time (logical 1) to the signal period.

In practice, the processing circuit 112 can be realized by general purpose processors, digital signal processors (DSPs), application specific integrated circuits (ASICs), field programmable gate arrays (FPGAs), other programmable logic circuits, or combinations thereof. The interface circuit 114 can be realized by any suitable receiver circuit supporting the signal format of DisplayPort, HDMI and/or DVI. The storage element 116 may be a non-volatile memory, such as the read-only memory (ROM), the flash memory, or other suitable type of memory, but this disclosure is not limited thereto. The display panel 140 can be realized by the liquid crystal display panel. In some embodiments, the control chip 110 may be the scaler IC.

Figure 3:
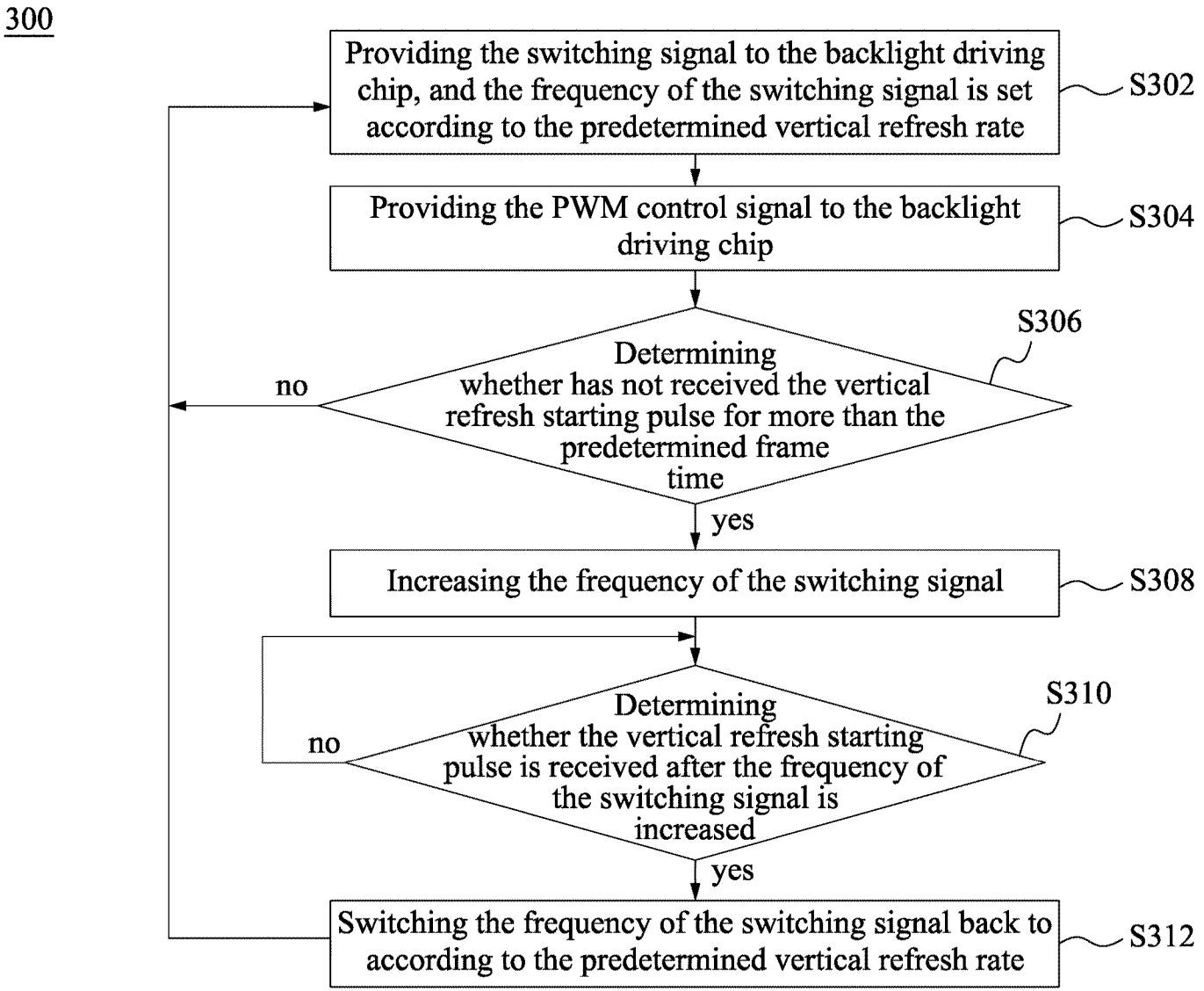
FIG. 3 is a flowchart of a driving method according to one embodiment of the present disclosure.

FIG. 3 is a flowchart of a driving method 300 according to one embodiment of the present disclosure. The control chip 110 may execute the driving method 300 to adaptively determines, according to the vertical refresh rate currently being applied, the frequency that the backlight module 130 being switched on and off (herein after referred to as "switching frequency of the backlight module 130"). Referring to FIGS. 1 and 3, in operation S302, when the processing circuit 112 receives a vertical refresh starting pulse Ptv of the vertical sync signal Vsync, the processing circuit 112 provides the switching signal Sw to the backlight driving chip 120. In this situation, the frequency of the switching signal Sw is set according to the predetermined vertical refresh rate stored in the storage element 116. For example, the frequency of the switching signal Sw can be set to equal to the predetermined vertical refresh rate of the display panel 140. In other words, the time length of the first stage S1 of each frame (i.e., one period of the switching signal Sw) is equal to the reciprocal of the predetermined vertical refresh rate. For example, if the predetermined vertical refresh rate is 120 Hz, the first stage S1 has 8.33 microseconds (ρs).

As shown in FIG. 2, when the switching signal Sw has a logic high level (e.g., a high voltage), the backlight driving chip 120 outputs the driving current Idr to enable the backlight module 130. On the contrary, when the switching signal Sw has a logic low level (e.g., a low voltage), the backlight driving chip 120 disables the backlight module 130. In this embodiment, the switching signal Sw may have a rather low duty cycle (e.g., 10%) to realize strobe backlight, but this disclosure is not limited thereto.

In operation S304, the processing circuit 112 provides the PWM control signal Pm to the backlight driving chip 120, thereby controlling the value of the driving current Idr by the duty cycle of the PWM control signal Pm. In some embodiments, the processing circuit 112 determines the duty cycle of the PWM control signal Pm, according to a brightness parameter specified by an user by using an external input interface (not shown), to adjust the brightness of the backlight module 130.

In operation S306, the processing circuit 112 determines whether the processing circuit 112 has not received the vertical refresh starting pulse Ptv for more than a predetermined frame time corresponding to the predetermined vertical refresh rate. For example, if the predetermined vertical refresh rate is 120 Hz, the predetermined frame time is 8.33 μs. In other words, the processing circuit 112 in this embodiment determines whether has not received the vertical refresh starting pulse Ptv for more than the time length of the first stage S1. If the vertical refresh starting pulse Ptv has not been received in the predetermined frame time, the processing circuit 112 then conduct operation S308 to adaptively adjust, in response to the decreased vertical refresh rate, the switching frequency of the backlight module 130. On the contrary, the processing circuit 112 may repeatedly conduct operation S302.

In operation S308, the processing circuit 112 increases the frequency of the switching signal Sw, and may keep the duty cycle of the switching signal Sw unchanged. Therefore, if a frame has a second stage S2 which results from the decreased vertical refresh rate and follows the first stage S1, the user will feel substantially the same equivalent brightness in the first stage S1 and the second stage S2, which is because the switching signal Sw has the same duty cycle (e.g., remaining in 10%) in both of the first stage S1 and the second stage S2.

In some embodiments, when the processing circuit 112 increases the frequency of the switching signal Sw, the processing circuit 112 may keep the duty cycle of the PWM control signal Pm unchanged.

In operation S310, the processing circuit 112 determines whether the vertical refresh starting pulse Ptv is received after the frequency of the switching signal Sw is increased. If the vertical refresh starting pulse Ptv is received after the frequency of the switching signal Sw is increased, the processing circuit 112 then conducts operation S312. On the contrary, the processing circuit 112 may repeatedly conduct operation S310.

In operation S312, the processing circuit 112 switches the frequency of the switching signal Sw back to according to the predetermined vertical refresh rate. For example, the processing circuit 112 can switch the frequency of the switching signal Sw back to equal to the predetermined vertical refresh rate. That is, the processing circuit 112 may interrupt the waveform that the switching signal Sw currently have and then configure the switching signal Sw to have a waveform the same as that of in the first stage S1. Then, the processing circuit 112 may conduct operation S302 again.

In some embodiments, the storage element 116 stores a predetermined horizontal refresh rate of the display panel 140. The predetermined horizontal refresh rate means that a predetermined refresh rate for a row of pixels in the display panel 140. For example, if the display panel 140 has a resolution of 2000×1144 (a resolution of 1920×1080 for the active area) and the predetermined vertical refresh rate of 120 Hz, the predetermined horizontal refresh rate of the display panel 140 may be calculate by Formula 1. In this case, the frequency of the switching signal Sw is increased to a value smaller than or equal to the predetermined horizontal refresh rate of the display panel 140.

Predetermined horizontal refresh rate=120×1144 Hz (Formula 1)

In the second stage S2, when the switching signal Sw has higher frequency, the last period of the switching signal Sw has less part going to be cut off. As a result, the user feels more constant equivalent brightness in the first stage S1 and the second stage S2.

In practice, to achieve variable vertical refresh rate, the horizontal refresh rate of the display panel 140 is set to be constant, while the time length of a frame may be extended in units of the refresh time for one row (i.e., the reciprocal of the predetermined horizontal refresh rate). Therefore, in some embodiments, the time interval between two successive vertical refresh starting pulses Ptv (e.g., the first stage S1 of the (N−1)-th frame, or the first stage S1 and the second stage S2 of the N-th frame) is configured as an integer multiple of the reciprocal of the predetermined horizontal refresh rate. As a result, if the frequency of the switching signal Sw is increased, in the second stage S2, to equal to the predetermined horizontal refresh rate, the time interval between two successive vertical refresh starting pulses Ptv will be an integer multiple of the period of the switching signal Sw, and thus the last period of the switching signal Sw, in the second stage S2, will not be cut off.

Figure 4:
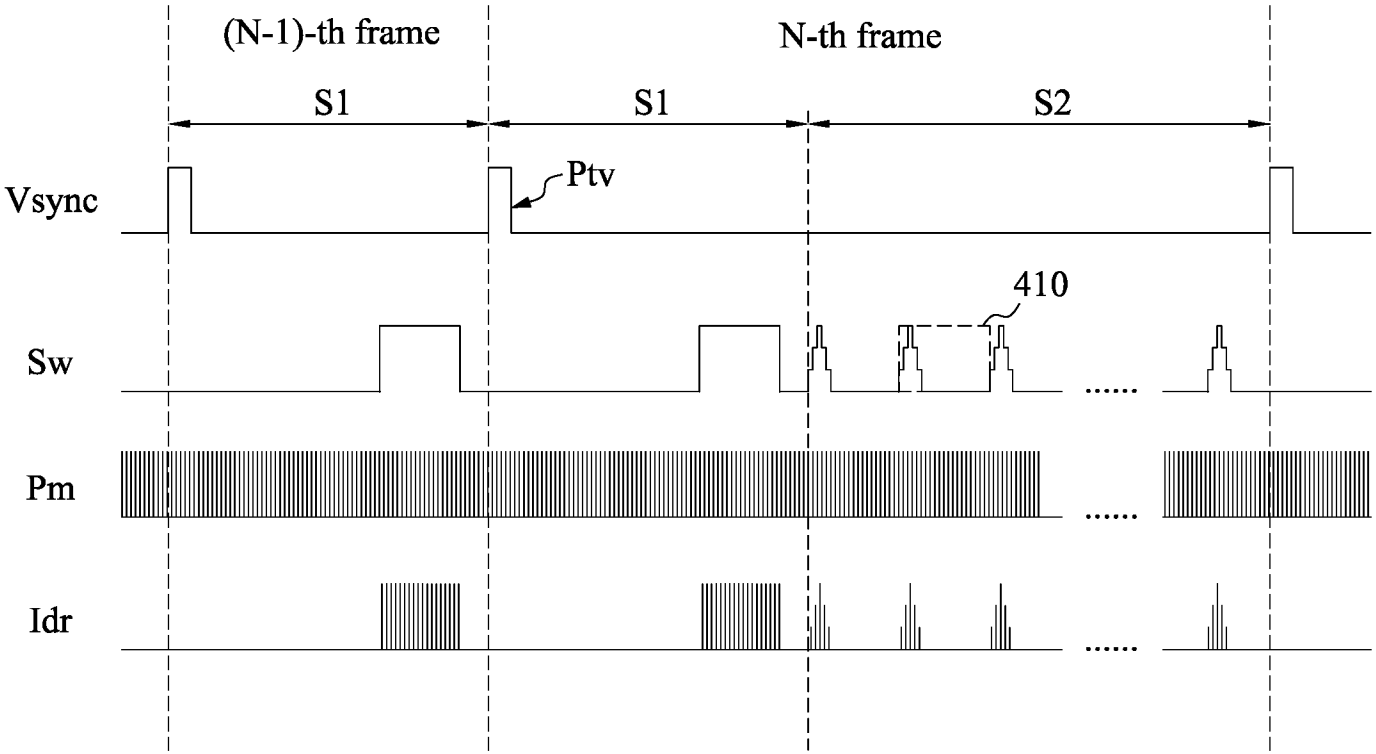
FIG. 4 is a waveform schematic diagram of a plurality of signals related to the display device of FIG. 1 according to another embodiment of the present disclosure.

FIG. 4 is a waveform schematic diagram of a plurality of signals related to the display device 100 according to another embodiment of the present disclosure. In this embodiment, when the control chip 110 conducts operation S308, the processing circuit 112 switches the switching signal Sw from the rectangular waveform to substantially similar to the triangular waveform. In specific, the processing circuit 112 configures the switching signal Sw, in the second stage S2, to have step waveform that rises step by step and then falls step by step so that the waveform of the switching signal Sw is approximate to the triangular waveform. In contrast with the rectangular waveform, the triangular waveform can be generated by circuits with slower charge and discharge speeds, and thus the processing circuit 112 in this embodiment has lower design difficulty. In addition, in the aforesaid embodiments that use triangular waveform to achieve equivalent average brightness, an area ratio of the triangular part to a rectangular 410, formed by the period of the triangular waveform, is equal to the duty cycle of the triangular waveform. For example, the rectangular 410 may have an area 10 times to that of the triangular part to achieve a 10% duty cycle.

As can be appreciated from the foregoing descriptions, the switching signal Sw provided by the control chip 110 may be a voltage signal that the waveform thereof can be rapidly changed, while the duty cycle of the PWM control signal Pm may remain the same and the backlight driving chip 120 simply determines whether to output the driving current Idr. Therefore, when the control chip 110 executes the driving method 300, the display device 100 avoids the problem that the PWM control signal Pm cannot rapidly changes the waveform thereof, and thus is capable of providing constant equivalent brightness under variable refresh rate.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A control chip, configured to be coupled with a backlight driving chip and a display panel, the control chip comprising:

a storage element, configured to store a predetermined vertical refresh rate of the display panel; and a processing circuit, coupled with the storage element, configured to provide a switching signal to the backlight driving chip so that the backlight driving chip enables a backlight module according to the switching signal, wherein a frequency of the switching signal is set according to the predetermined vertical refresh rate, wherein if the processing circuit has not received a vertical refresh starting pulse for more than a predetermined frame time corresponding to the predetermined vertical refresh rate, the processing circuit increases the frequency of the switching signal.

2. The control chip of claim 1, wherein when the processing circuit increases the frequency of the switching signal, the processing circuit keeps a duty cycle of the switching signal unchanged.

3. The control chip of claim 1, wherein the processing circuit is further configured to provide a control signal to the backlight driving chip so that the backlight driving chip determines, according to a duty cycle of the control signal, a brightness of the backlight module, and when the processing circuit increases the frequency of the switching signal, the processing circuit keeps the duty cycle of the control signal unchanged.

4. The control chip of claim 1, wherein the processing circuit increases the frequency of the switching signal to a value smaller than or equal to a predetermined horizontal refresh rate of the display panel.

5. The control chip of claim 1, wherein if the processing circuit has not received the vertical refresh starting pulse for more than the predetermined frame time, the processing circuit sets the switching signal to substantially have a triangular waveform.

6. The control chip of claim 1, wherein if the processing circuit has not received the vertical refresh starting pulse for more than the predetermined frame time, the processing circuit sets the switching signal to have a step waveform similar to the triangular waveform.

7. The control chip of claim 1, wherein if the processing circuit receives the vertical refresh starting pulse after the frequency of the switching signal is increased, the processing circuit switches the frequency of the switching signal back to according to the predetermined vertical refresh rate.

8. A display device, comprising:

a display panel;

a backlight module;

a backlight driving chip, coupled with the backlight module; and a control chip, coupled with the display panel and the backlight driving chip, and comprising:

a storage element, configured to store a predetermined vertical refresh rate of the display panel; and a processing circuit, coupled with the storage element, configured to provide a switching signal to the backlight driving chip so that the backlight driving chip enables the backlight module according to the switching signal, wherein a frequency of the switching signal is set according to the predetermined vertical refresh rate, wherein if the processing circuit has not received a vertical refresh starting pulse for more than a predetermined frame time corresponding to the predetermined vertical refresh rate, the processing circuit increases the frequency of the switching signal.

9. The display device of claim 8, wherein when the processing circuit increases the frequency of the switching signal, the processing circuit keeps a duty cycle of the switching signal unchanged.

10. The display device of claim 8, wherein the processing circuit is further configured to provide a control signal to the backlight driving chip so that the backlight driving chip determines, according to a duty cycle of the control signal, a brightness of the backlight module, and when the processing circuit increases the frequency of the switching signal, the processing circuit keeps the duty cycle of the control signal unchanged.

11. The display device of claim 8, wherein the processing circuit increases the frequency of the switching signal to a value smaller than or equal to a predetermined horizontal refresh rate of the display panel.

12. The display device of claim 8, wherein if the processing circuit has not received the vertical refresh starting pulse for more than the predetermined frame time, the processing circuit sets the switching signal to substantially have a triangular waveform.

13. The display device of claim 8, wherein if the processing circuit has not received the vertical refresh starting pulse for more than the predetermined frame time, the processing circuit sets the switching signal to have a step waveform similar to the triangular waveform.

14. The display device of claim 8, wherein if the processing circuit receives the vertical refresh starting pulse after the frequency of the switching signal is increased, the processing circuit switches the frequency of the switching signal back to according to the predetermined vertical refresh rate.

15. A driving method, suitable for a control chip configured to be coupled with a display panel and a backlight driving chip, the driving method comprising:

providing a switching signal to the backlight driving chip so that the backlight driving chip enables a backlight module according to the switching signal, wherein a frequency of the switching signal is set according to a predetermined vertical refresh rate of the display panel;

determining whether a vertical refresh starting pulse has not been received for more than a predetermined frame time corresponding to the predetermined vertical refresh rate; and if the vertical refresh starting pulse has not been received for more than the predetermined frame time, increasing the frequency of the switching signal.

16. The driving method of claim 15, wherein when the frequency of the switching signal is increased, a duty cycle of the switching signal is kept unchanged.

17. The driving method of claim 15, further comprising:

providing a control signal to the backlight driving chip so that the backlight driving chip determines, according to a duty cycle of the control signal, a brightness of the backlight module, wherein when the frequency of the switching signal is increased, the duty cycle of the control signal is kept unchanged.

18. The driving method of claim 15, wherein the frequency of the switching signal is increased to a value smaller than or equal to a predetermined horizontal refresh rate of the display panel.

19. The driving method of claim 15, wherein if the vertical refresh starting pulse has not been received for more than the predetermined frame time, the switching signal is set to substantially have a triangular waveform.

20. The driving method of claim 15, further comprising:

determining whether the vertical refresh starting pulse is received after the frequency of the switching signal is increased; and if the vertical refresh starting pulse is received after the frequency of the switching signal is increased, switching the frequency of the switching signal back to according to the predetermined vertical refresh rate.

* * * * *